United States Patent [19]

Al-Harbi

[11] Patent Number: 4,860,684

[45] Date of Patent: Aug. 29, 1989

[54] INFANT BOTTLE TIMER APPARATUS

[76] Inventor: Tarik S. Al-Harbi, 60 E. 32nd St. #712, Chicago, Ill. 60616

[21] Appl. No.: 195,894

[22] Filed: May 19, 1988

[51] Int. Cl.[4] ..... G09F 9/40

[52] U.S. Cl. ..... 116/308; 40/310; 116/324

[58] Field of Search ..... 40/310; D24/47, 48; 116/306, 308, 309, 311, 312, 315, 321–324, 224, 225; 215/11.2, 365; 222/44, 45, 49, 50

[56] References Cited

U.S. PATENT DOCUMENTS

| | | | |
|---|---|---|---|
| D. 47,393 | 5/1915 | Wheaton | D24/47 |
| D. 137,510 | 3/1944 | Eisele | D24/47 |
| D. 165,274 | 11/1951 | Dvonch | D24/47 |
| D. 196,999 | 11/1963 | Siegel | D24/48 |
| D. 212,921 | 12/1968 | Bloomberg | D24/47 |
| D. 251,612 | 4/1979 | Lagergren et al. | D24/47 |
| 1,317,660 | 9/1919 | Carlson | 116/308 |
| 1,590,793 | 6/1926 | Aitken | 116/323 |
| 2,450,949 | 10/1948 | Gattuccio et al. | 116/308 |
| 2,528,259 | 10/1950 | Annunziata | 116/308 |
| 2,593,868 | 4/1952 | Fowler | 215/365 |
| 4,548,157 | 10/1985 | Hevoyan | 116/308 |
| 4,713,900 | 12/1987 | Calloway, Jr. et al. | 40/324 |

FOREIGN PATENT DOCUMENTS

| | | | |
|---|---|---|---|
| 68109 | 9/1892 | Fed. Rep. of Germany | 116/308 |

*Primary Examiner*—William A. Cuchlinski, Jr.
*Assistant Examiner*—W. Morris Worth
*Attorney, Agent, or Firm*—Leon Gilden

[57] ABSTRACT

An infant bottle timer apparatus is set forth where an encircling indexed band is fixedly securable to an associated exterior surface of a baby bottle-type feeding implement. The timer apparatus includes a lowermost portion indexed consistent with the hours of the day and a pointer selectively manipulatable within an overlying integrally formed track for indication of a subsequent feeding timing event. The track includes a channel capturing a leaf spring. The leaf spring is secured to and cooperates with the pointer which is of a generally "H" shaped cross-sectional configuration. A first pair of legs of the "H" shaped pointer is ridable within the channel and frictionally securable within the channel in cooperation with the leaf spring. A further pair of legs of the "H" shaped pointer are oriented exteriorly of the channel for indication of a subsequent feeding event in cooperation with the indicator band. The indicator band is formed as an extension of a rear portion of the channel for providing a unitary compact structure in cooperative association with the baby bottle.

6 Claims, 2 Drawing Sheets

INFANT BOTTLE TIMER APPARATUS

BACKGROUND OF THE INVENTION

1. Field of the Invention

The field of invention relates to timing devices, and more particularly pertains to a new and improved timer apparatus for use in combination with baby bottles for indication of a subsequent feeding time for an infant.

2. Description of the Prior Art

The use of timing devices in the care of infants is well known in the prior art. The infant requires feeding at predetermined hours of varying durations as the infant matures, but the time sequence may involve several hours or less, dependent upon the particular nature of infant care required, such as the inclusion of special feeding formulas and the like. In this vein, therefore, it is at times difficult to properly chart and program for predetermined infant feedings of varying times and nature wherein associated time mechanisms are frequently inconveniently positioned throughout a household or due to the nature of infant care, appropriate timing mechanisms are not properly utilized.

Baby bottles themselves are of a straight-forward and simple design wherein accessories for the assistance and infant care have not contemplated the need for a proper indication of timing for subsequent infant feeding. Examples of prior art devices are set forth in U.S. Design Pat. No. 47,393 to Wheaton setting forth the conventional volumetric indicators on a baby bottle for display of internal contents of the bottle. U.S. Design Pat. No. 137,510 to Eisele has set forth the use of a thermometer in conjunction with an infant bottle for indication of temperature, whereas Design Pat. No. 165,274 to Dvonch and U.S. Design Pat. No. 251,612 to Lagergren has set forth basic indicator indicia imposed on an infant feeding bottle for volumetric content measurement of the associated bottle. U.S. Design Pat. No. 196,999 to Siegel sets forth an illustration of an infant bottle carrying case, and U.S. Design Pat. No.212,921 to Bloomberg sets forth a further volumetric indicator of indicia imposed on a baby bottle with an associated carrying handle and ornamental support stand.

The aforenoted patents have been cited of interest relative to the indication of the direction of previous patent activity that appears to have been directed to configurational indicia in association with a baby bottle whereas the instant invention sets forth a cooperating apparatus for the use with a baby bottle for indicating of subsequent feeding times of an infant for manipulation by an individual in use of the apparatus.

As such, it may be appreciated that there is a continuing need for a new and improved baby bottle timing mechanism which addresses both the problem of convenience and cooperation with an associated baby bottle, and in this respect the present invention substantially fulfills this need.

SUMMARY OF THE INVENTION

In view of the foregoing disadvantages inherent in the known types of timing mechanisms now present in the prior art, the present invention provides an infant bottle timer mechanism wherein the same is compactly associated with an infant baby bottle in use and may be further efficiently and readily transported and manipulated with such bottle in use. As such, the general purpose of the present invention, which will be described subsequently in greater detail, is to provide a new and improved infant bottle timer apparatus which has all the advantages of the prior art timing mechanisms and none of the disadvantages.

To attain this, the present invention comprises an encircling band securable and associatable to a baby bottle and formed as an encircling band with a lowermost portion of said band having provided therewith indicia to indicate and define a twenty-four hour sequence of hours by use of whole number digits and dividing the spacing between the digits into four equally spaced portions for indication of fifteen minute intervals therebetween. An upper portion of said band has formed thereto an "L" shaped channel enclosing a leaf spring formed with a protuberance positioned within a recess of a pointer device. The pointer device is generally of an "H" shaped cross-sectional configuration with an interior plurality of legs formed with recesses at terminal ends thereof for riding over inwardly turned opposed flanges of the channel. The remaining pair of legs of the "H" shaped cross-sectional configuration are positioned overlying said channel and include a pointer for cooperation with said underlying timing band for indication of a subsequent feeding interval. The channel has formed a series of opposed recesses within the aforenoted opposed flanges in alignment with the aforenoted digits of the timing band for cooperation with the inwardly oriented legs of the "H" shaped indicator to secure a position the indicator within said opposed recesses.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved infant bottle timer apparatus which has all the advantages of the prior art timing mechanisms and none of the disadvantages.

It is another object of the present invention to provide a new and improved infant bottle timer apparatus which may be easily and efficiently manufactured and marketed.

It is a further object of the present invention to provide a new and improved infant bottle timer apparatus which is of a durable and reliable construction.

An even further object of the present invention is to provide a new and improved infant bottle timer apparatus which is susceptible of a low cost of manufacture with regard to both materials and labor, and which accordingly is then susceptible of low prices of sale to the consuming public, thereby making such infant bottle timer apparatus economically available to the buying public.

Still yet another object of the present invention is to provide a new and improved infant bottle timer apparatus which provides in the apparatuses and methods of the prior art some of the advantages thereof, while simultaneously overcoming some of the disadvantages normally associated therewith.

Still another object of the present invention is to provide a new and improved infant bottle timer apparatus in association with an infant bottle of conventional construction for indication of subsequent infant feeding events.

Yet another object of the present invention is to provide a new and improved infant bottle timer apparatus provided with an encircling band formed with underlying indicia corresponding to hours and quarter hours of a day with an overlying track for cooperation with said indicia for indication of subsequent infant feeding events.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
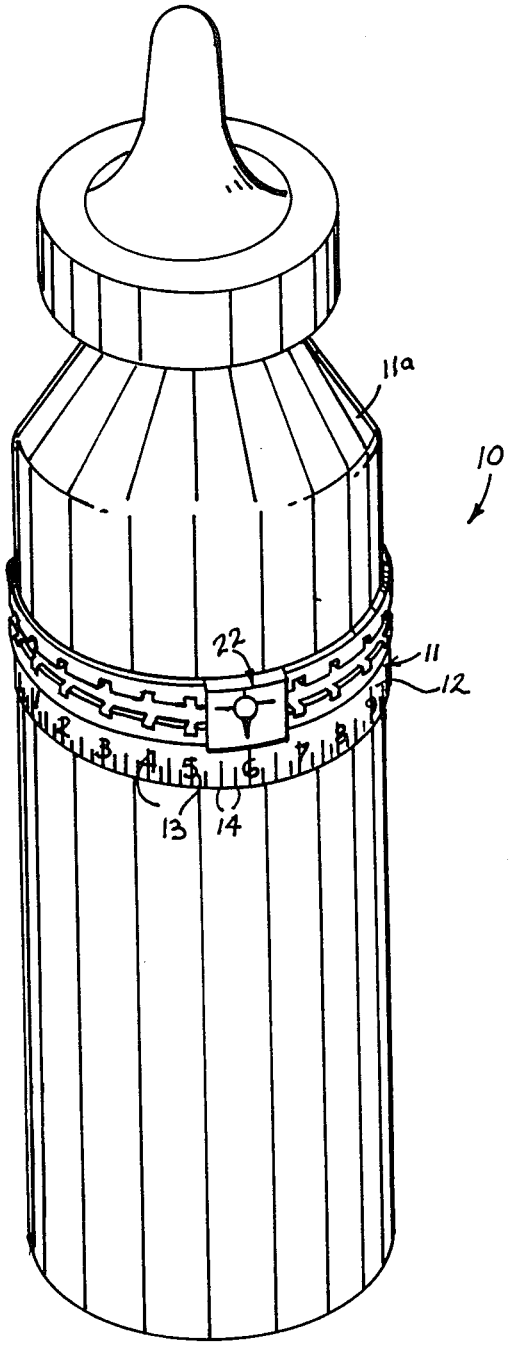
FIG. 1 is an isometric illustration of the instant invention.
Figure 2:
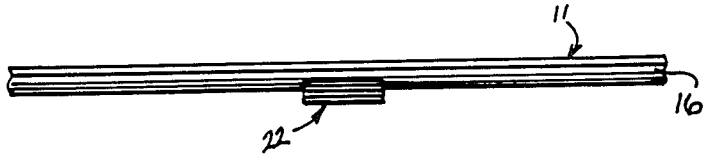
FIG. 2 is a top orthographic sectional view of a portion of the invention.

With reference now to the drawings, and in particular to FIGS. 1 to 5 thereof, a new and improved infant bottle timer apparatus embodying the principles and concepts of the present invention and generally designated by the reference numeral 10 will be described.

More specifically, the infant bottle timer apparatus 10 essentially comprises an encircling band 11 secured to an infant feeding bottle 11*a* of conventional construction. A lower exterior face 12 of the band 11 has formed thereon, while number digits 13 indicating whole hour intervals with quarter hour indicia 14 positioned therebetween. The hour and quarter hour indicators provide convenient and immediate visual indication of a subsequent feeding required for an infant when utilized in conjunction with an associated indicator slide 22 slidable and positionable relative to a respective digit or indicia 13 or 14 by visual cooperation with an indicator arrow 24 on slide 22.

Figure 3:
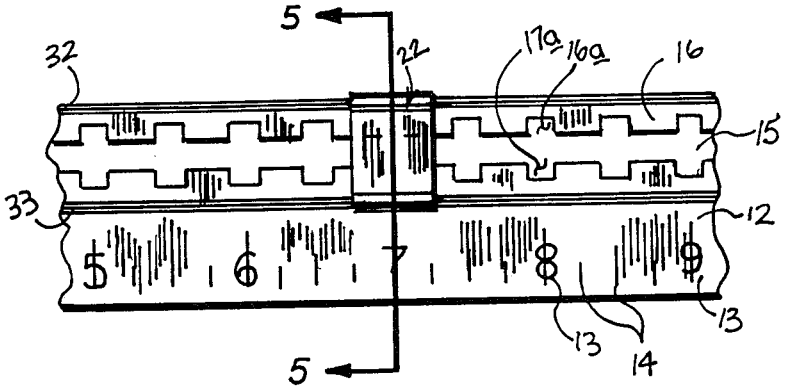
FIG. 3 is an orthographic view taken in elevation of the instant invention.
Figure 4:
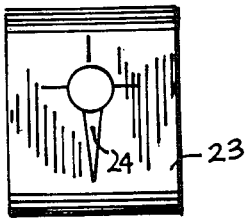
FIG. 4 is an orthographic view taken in elevation of the indicator slide as utilized with the instant invention.
Figure 5:
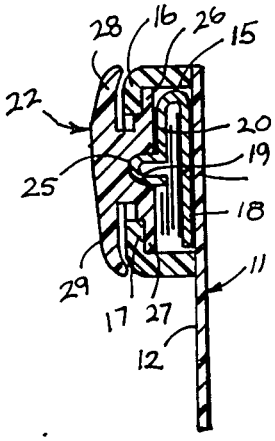
FIG. 5 is an orthographic view taken along the lines 5—5 of FIG. 3 in the direction indicated by the arrows.

An upper exterior face 15 of the band 11 has integrally secured thereto an upper rail 32 at a spaced distance parallel to lower rail 33 wherein each rail is formed of a generally "L" shaped configuration, as illustrated in FIG. 5, with an upward and inwardly depending flange 16 integrally formed to the upper rail 32 and an inwardly directed lower flange 17 forming therebetween a spaced gap and an included channel as illustrated in FIGS. 1, 3, and 5. The upper and lower respective flanges 16 and 17 have formed therein aligned recesses comprising upper recesses 16*a* and lower recesses 17*a* conveniently disposed in alignment with the whole hour digits 13 and optionally, as illustrated in FIG. 3, with the half hour indicators of the quarter hour indicia 14. The aligned recesses cooperate with the slide 22 to maintain the slide in the aligned recesses and minimize inadvertent movement of the slide 22 to prevent incorrect indication of a future infant feeding event.

A leaf spring 18, as illustrated in FIG. 5, is captured within the channel defined by the upper external face 15 and the upper and lower respective rails 32 and 33. The leaf spring 18 is of a generally "U" shaped configuration with a first planar leg 19 slidable against the exterior face 15 and of an extent approximately equal to that of the face 15 with a shorter second leg 20 terminating in a protuberance 21 wherein said protuberance 21 is aligned orthogonally relative to the first leg 19.

The cooperating indicator slide 22 is formed with an exterior face 23 and the associated indicator arrow 24 in cooperation with the indicia on lower face 12, as noted above. The indicator slide 22 is formed of a generally "H" shaped cross-sectional configuration with an interior face formed with a recess 25 of complementary configuration to accept the protuberance 21 of spring 18 and secure spring 18 and slide 22 together in unitary movement.

The "H" shaped configuration of slide 22 includes an upper inner leg 26 and a lower inner leg 27 cooperating with interior surfaces of respective upper flange 16 and lower flange 17 for guidingly maintaining orientation respectively thereto by elongate interior notches formed within the upper and lower respective legs 26 and 27 for complementary sliding engagement with interior corners of the respective upper and lower flanges 16 and 17.

Upper and lower outer legs 28 and 29 respectively are oriented generally parallel to the inner legs 26 and 27 and are overlying the respective flanges 16 and 17 wherein the upper and lower rails 32 and 33 capture the indicator slide 22 between the coextensive flanges 16 and 17.

In this manner, the infant bottle timer apparatus 10 may be manipulated to position the slide 22 as desired for indication of a subsequent timing event for the feeding of an intended infant.

As to the manner of usage and operation, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An infant bottle timer apparatus comprising in combination, an infant nursing bottle, and an encircling band timer means secured about an external surface of said bottle orthogonally thereto relative to a central axis of said bottle, and said band timer means including a bottle contact band adjacent to and in contact with said bottle and a lower external face of said band including timing indicia corresponding to hours and portions of hours of a twenty-four hour time cycle equally spaced along the band, and an upper external face of said band having movable secured thereto an indicator slide means captured between an upper and lower parallel coextensive rail means secured to said upper external face for mounting said indicator slide means for movement therebetween, said slide means being mounted for parallel movement relative to said lower face with a pointer marking imposed thereon for cooperation with said timing indicia for indication of an infant feeding events and wherein said upper and lower rail means each include an inwardly directed flange formed with spaced and aligned recesses for securement of a portion of said slide means within said aligned spaced recesses such that said pointer marking registers with one of said timing indicia.

2. An infant bottle timer apparatus as set forth in claim 1 wherein said upper and lower rail means define a channel in cooperation with said upper external face, said slide means including a "U" shaped leaf spring secured within said channel having a first leg parallel to said upper external face and of a length substantially equal to the spacing between said upper and lower rail means wherein said spring is formed with a second leg of a length less than said first leg wherein said second leg terminates in a protuberance orthogonally aligned relative to said first leg.

3. An infant bottle timer apparatus as set forth in claim 2 wherein said slide means includes a slide member which is formed of a generally "H" shaped cross-sectional configuration with an interior face positioned within said channel and formed with a recess of complementary configuration to said protuberance for cooperative engagement of said slide member and said leaf spring.

4. An infant bottle timer apparatus as set forth in claim 3 wherein said slide member further includes an upper inner leg and lower inner leg in sliding contact with said flanges of said upper and lower rail means respectively and wherein said upper and lower inner legs are formed with notches for sliding engagement of said upper and lower inner legs with said inwardly directed flanges of said rail means.

5. An infant bottle timer apparatus as set forth in claim 4 wherein said slide member further includes an upper and lower outer leg to capture the flange of said upper rail means between said outer and inner upper legs and to capture said flange of said lower rail means between said outer and inner lower legs.

6. An infant bottle timer apparatus as set forth in claim 5 wherein said leaf spring and said slide member are integrally secured together whereby said leaf spring, rail means and said slide member cooperatively maintain said slide means at a predetermined orientation with respect to said channel.

* * * * *